US005669822A

United States Patent [19]

Smollar et al.

[11] Patent Number: 5,669,822

[45] Date of Patent: *Sep. 23, 1997

[54] WATER SLIDE

[75] Inventors: Marvin Smollar, Northbrook; Richard Barry Mazursky, Glenview, both of Ill.

[73] Assignee: Empire Industries, Inc., Delray, Fla.

[ * ] Notice: The term of this patent shall not extend beyond the expiration date of Pat. No. 5,507,696.

[21] Appl. No.: 561,592

[22] Filed: Nov. 21, 1995

Related U.S. Application Data

[63] Continuation of Ser. No. 263,017, Jun. 20, 1994, abandoned, which is a continuation of Ser. No. 212,897, Jun. 29, 1988, abandoned.

[51] Int. Cl.[6] ..... A63G 21/18

[52] U.S. Cl. ..... 472/117

[58] Field of Search ..... 472/116, 117; 104/69, 70; 4/488, 506; 193/25 A, 25 R

[56] References Cited

U.S. PATENT DOCUMENTS

| | | | |
|---|---|---|---|
| Re. 34,042 | 8/1992 | Merino | 472/117 |
| 2,982,547 | 5/1961 | Carrier | 472/117 |

FOREIGN PATENT DOCUMENTS

| | | | |
|---|---|---|---|
| 2110944 | 6/1983 | United Kingdom | 472/117 |

OTHER PUBLICATIONS

Exhibits From Interference No. 102, 136 Which Show Prior Art As Found By the Board of Patent Appeals and Interferences CX5,CX6,CX7,CX8,CX27,CX28,CX76A,CX116A).

Paper 190 From Interference No. 102, 136; Mar. 3, 1993.

*Primary Examiner*—Michael Safavi

*Attorney, Agent, or Firm*—Laff, Whitesel, Conte & Saret, Ltd.

[57] ABSTRACT

A water slide is made from a plurality of plastic sheets welded together to form intercommunicating tubes which may be filled with water. Some of the tubes form the side walls of a pool. Other of the tubes form bumps of graduated height to provide a ramp at the end of a slide. A child runs toward the slide, bellyflops on it, slides over the ramp and splashes down in the pool. The water filled tubes additionally provide a shock absorbing effect.

13 Claims, 4 Drawing Sheets

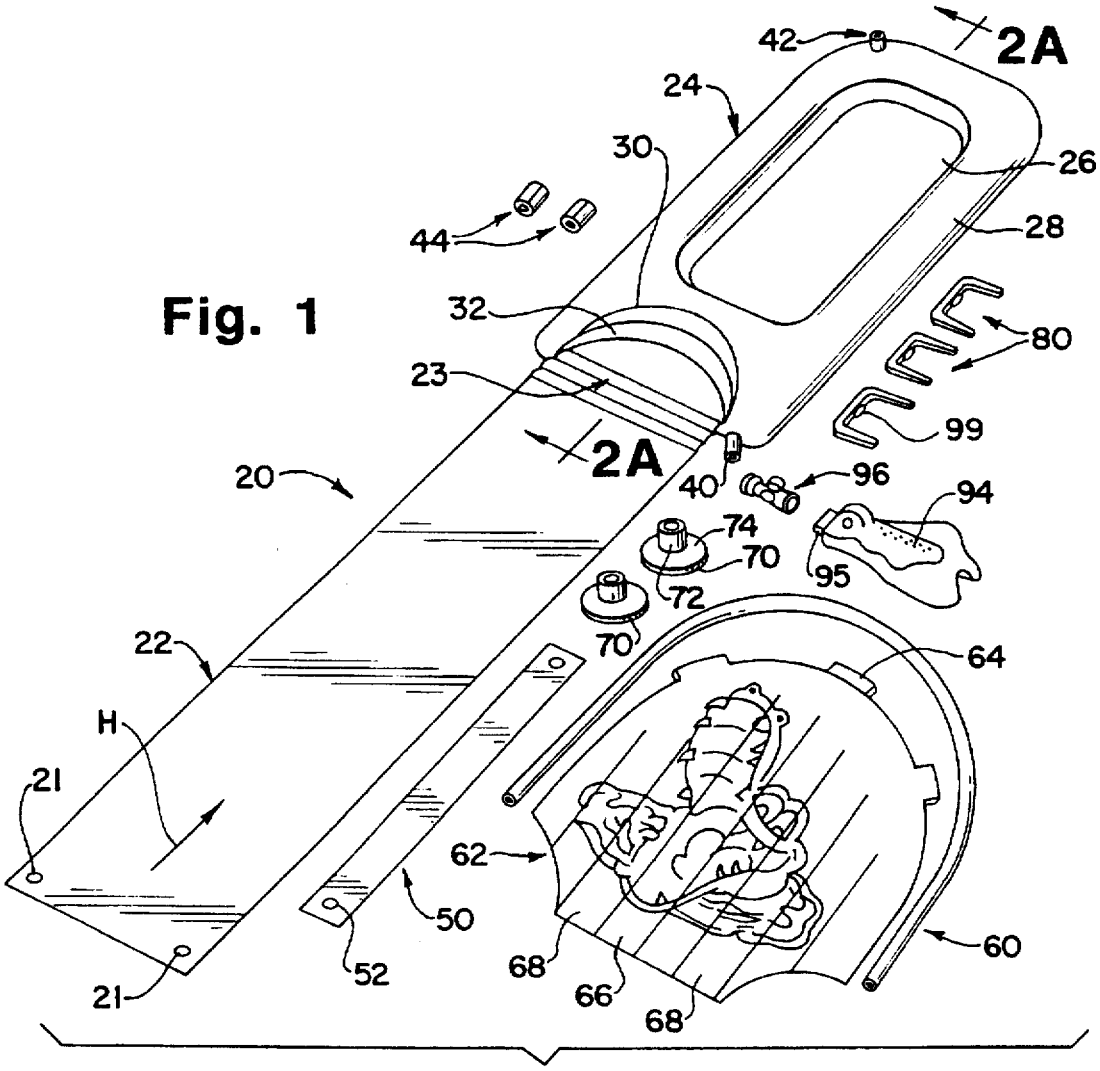
Fig. 1
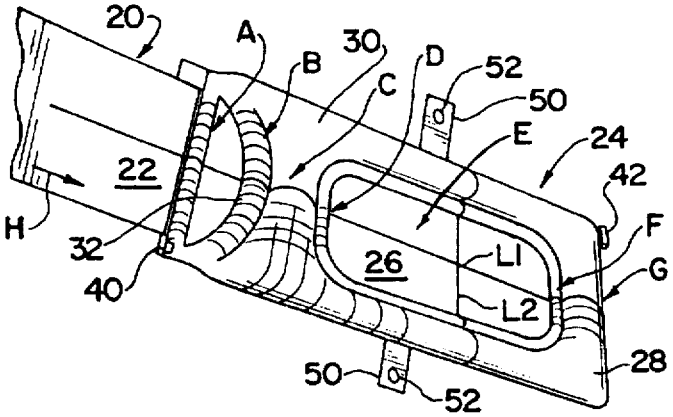
Fig. 2
Fig. 2A
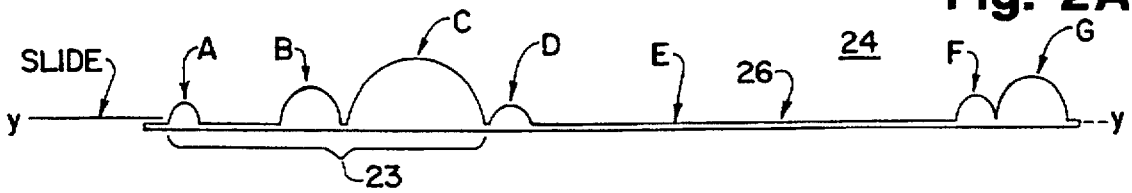

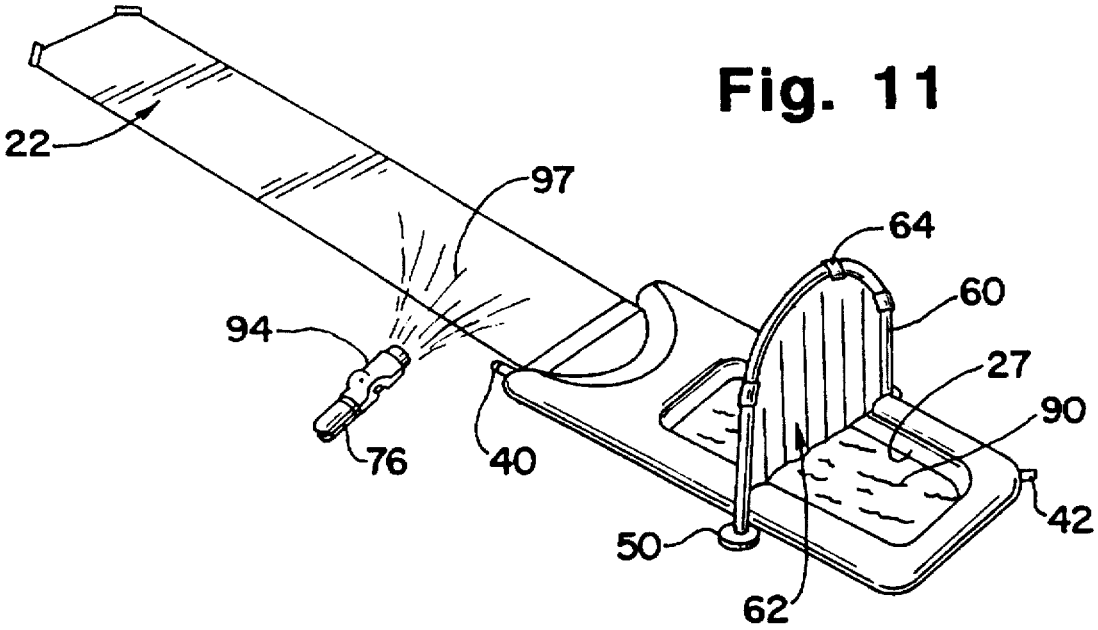
Fig. 11
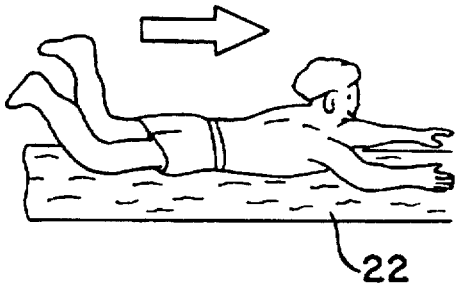
Fig. 12A
Fig. 12B
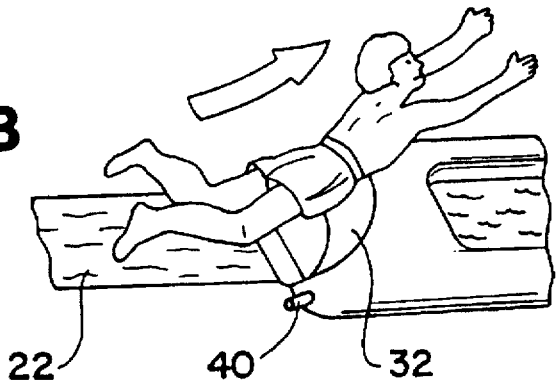

WATER SLIDE

This application is a continuation of prior application Ser. No. 08/263,017, filed Jun. 20, 1994, which in turn, was a continuation of Ser. No. 07/212,897 filed Jun. 29, 1988 now abandoned.

FIELD OF THE INVENTION

The invention relates to water slides that are placed on the ground and preferably over grass, and that become lubricious when covered with a thin layer of water. More particularly, the invention relates to a water slide made of a flexible material that may be attached to the ground and then covered with a thin layer of water to decrease the surface friction so that persons, primarily children, may sequentially slide across the material.

BACKGROUND OF THE INVENTION

Existing toys use flexible material laid on the ground and covered with a thin layer of water to decrease friction in order to enable people to slide across the material. There are various means for attaching the material to the ground and for supplying a more or less constant layer of water onto the upper surface of the material. Relevant considerations of the toy and recreational industry also include providing a safe product, a means for attaching the sheet firmly to the ground and a constant layer of water on the sheet.

The "Wet Banana" (TM) slide manufactured by Koki, Inc., is one example of such prior art. It has a rectangular plastic sheet, metal brackets to attach the plastic sheet to the ground, and a "Banana" sprinkler that is curved and has water emission holes positioned along the curves so that the water spray covers an area of the plastic sheet.

Another example of the prior art is the "Wham-O Slip n'Slide" as disclosed in U.S. Pat. No. 2,982,547. This slide includes a plastic sheet, means for attaching the sheet to the ground, and a sprinkler that is part of the sheet and is formed by a perforated tube positioned lengthwise along at least one of the edges of the sheet. A garden hose is connected to the sprinkler. On the top side of the sheet, a plurality of holes are punched into the tube to provide for water emission from the tube onto the sheet.

Still another prior art device is the Wet'n'Wacky (™) water slide produced by Marchon, Inc., the common assignee of the present invention. That device includes a rectangular sheet of flexible material fastened at each corner to the ground by plastic staple-like stake members. A unique sprinkler nozzle is encased in a stylized animal head, or the like, for spreading water over the sheet and for providing a semi-flexible covering for the nozzle means. The water emanates from the spray head via a specially designed sprayer that generates a continuous fan of water across the surface of the slide.

SUMMARY OF THE PRESENT INVENTION

An object of the invention is to provide a lubricious slide connected to a ramp/bump leading to a pool.

Another object of the invention is to provide a preferably water filled ramp and bumper surrounding the pool. The water filled ramp/bump provides a cushioned lift for projecting a person into the pool. The bumper provides means for stopping the forward motion of such person at the rear of the pool.

A further object of the invention is to provide new play features not previously found in the prior art. A still further object is to simulate the fun and thrills of a water ride in an amusement park within one's own back yard.

Still another object of the invention is to provide a safely secured slide, together with means for elevating the sliding person's body above the plane of the slide. Due to the kinetic energy present in the sliding person's body, the elevation means propels the person into the air for a short distance off the plane of the slide, and further provides a splash down pool in which the person may land without physical harm.

Yet another object of the invention is to provide a ramp/bump or other means that will withstand the impact of a person's body. The ramp/bump has a cushioning effect if the sliding person does not have enough velocity to reach the pool. It also provides a pool having perimeter walls that are filled, preferably, with water to give a softer cushioning effect.

Still another object of the invention is to provide a flexible curtain-like member over the slider's path to the pool. The curtain is positioned transversely to the path normally travelled by a sliding person who is elevated off the plane of the slide by the ramp/bump and projected through the air and into the pool. The curtain-like means may include indicia or other means which add to the excitement incurred when a person is projected therethrough.

A still further object of the invention is to provide means for filling the toroidal walls of the pool with water from a standard garden hose fitting. Yet another object is to provide means for preventing an overfilling or overpressurizing of the wall of the pool.

These and other objects of the invention will be apparent to those skilled in the art when the following figures of the drawing are studied in conjunction with the specification.

BRIEF DESCRIPTION OF THE DRAWINGS

A preferred embodiment of the invention is shown in the attached drawing wherein:

FIG. 1 is an exploded perspective view of the unassembled components making up the invention;

FIG. 2 is a partial perspective view of the pool end of the integral slide, with at least one ramp/bump, and a pool element, showing its disposition on the ground, the pool overlying a hoop retaining strap which projects outwardly from opposite sides thereof;

FIG. 2A is a schematic cross-sectional view taken along line 2—2 of FIG. 1, showing a preferred embodiment of the ramp/bump, including a plurality of bumps having graduated height;

FIG. 11 is a perspective view of a preferred embodiment of the invention in an assembled condition, with the pool cavity filled with water, and with the sprinkler head inundating the slide with a constant fan-shaped supply of water for creating a lubricious condition on the sliding surface and for filling the pool as may be necessary for a proper usage thereof; and FIGS. 12A and 12B show a first side elevational view of a person sliding down the slide portion and, in the second view, showing the person encountering the ramp/bump means and being projected upwardly and over the ramp into the pool.

DETAILED DESCRIPTION OF THE INVENTION

Figure 3A:
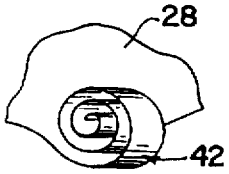
FIG. 3A is an enlarged detail showing one method of sealing the inlet/outlet tube.

FIG. 2 is a perspective view of the inventive device in an inflated condition. This figure includes two heavily inked lines L1, L2 and a number of lightly inked lines, which are supplied to show the general contours of the inventive device, after an inflation thereof. In the various figures, similar parts are designated by similar numerals.

Preferably, the water slide 20 is integral with a pool and includes an elongated generally lubricious slide portion 22 connected via a ramp/bump portion 23 to pool portion 24. The pool portion 24 includes a generally planar base element 26. Surrounding and forming the perimeter wall for the pool base 26 is a generally U-shaped, semi-toroidal, hollow wall 28 enclosing one end wall of base 26. A broader transverse portion 30 extends between the two longer arms of wall 28. One side of the transverse portion 30 is provided with a smaller ramping section 32 facing the slide portion 22. The wall 32 is curved to give a sloped, generally semi-circular concave configuration facing anyone who may be sliding down the slide 22 in order to guide and direct him into the pool. The ramp or slanted wall 32 blends into the transverse portion 30 to give a ramp/bump.

A child who uses the inventive device is confronted by the ramp/bump at the end of the slide, which ramp/bump propels him upwardly into the air and then into a shallow splash down pool 24. More particularly, a plurality of bumps "A" through "N" of graduated height form a ramp 23 (FIG. 2A). Each bump performs a specific function. Bumps "A" and "B" are graduated in height so as to lead smoothly into the highest ramp or bump "C" together elevating the body of the person sliding along area 22 in direction "H". Bump "A" also aids in keeping the leading edge of the slide transversely taut, from side edge to side edge. The bump "D" is generally part of the edge wall of the pool, but it also cushions the landing of the person going over the ramp/bump. Bump "F" provides a graduated exit ramp leading into larger bumper "G". The various bumps also add additional areas to absorb energy and act as a shock absorber to the sliding person. The tubular members forming these bumps are made by sealing together generally plastic sheets forming base 26.

At opposite ends of the pool portion 24 are inlet/outlet tubes 40 and 42, which have several functions. First, it is desirable to have two tubes, as opposed to a single opening, in order to facilitate emptying. This is especially important since emptying the water could prove to be very cumbersome if there is only one opening and the slide is on an incline.

The water slide is deployed by being unrolled onto a cleaned, pre-wetted, and grassy area. Retaining strap 50 is transversely positioned under the pool portion 24 with apertures 52, 52 disposed substantially equidistant from opposite pool edges. The inlet and outlet tubes 40, 42 generally communicate with the interior of the pool wall 28. Except while open for filling or emptying the pool walls, these tubes 40, 42 are, in one embodiment, rolled along a line which is transverse to the tube axis, as best seen in FIG. 3A. A C-shaped spring clip 44 is slipped over the rolled tube to retain it in a sealed condition in order to prevent leakage. Other clamping means can also be used.

The resilience of spring clip 44 is selected so that the rolled tube will open the clip enough to cause the pool wall to leak before the pressure inside the pool walls becomes great enough to rupture them.

Figure 4:
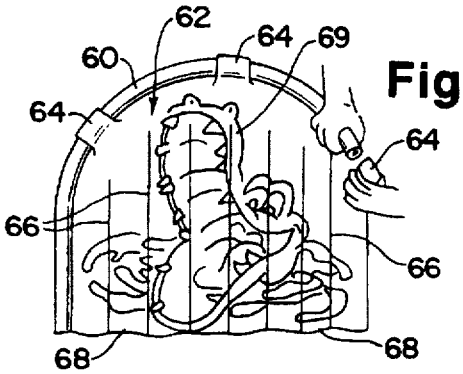
FIG. 4 is a partial detail showing an assembly of an embodiment of a curtain-like means with its supporting hoop shaped arch means.
Figure 4A:
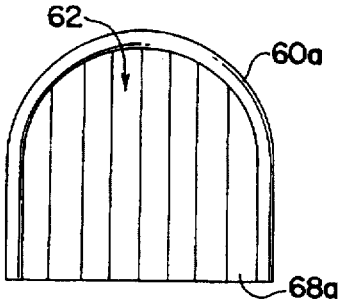
FIG. 4A is a vertical elevation of another embodiment of the curtain-like means wherein the supporting hoop and slit curtain-like means are integral and the supporting hoop is a member which is inflated to provide rigidity.
Figure 5A:
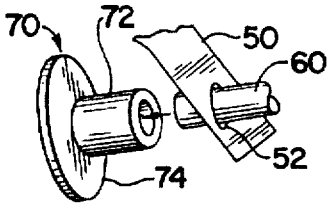
FIGS. 5A and 5B show the details of an assembly of a hoop shaped arch means with the retaining strap and the flanged cylindrical support means that will maintain the curtain-like means in a transversely disposed vertical relationship to the pool.
Figure 5C:
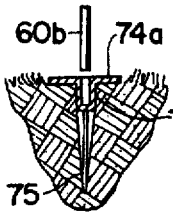
FIG. 5C shows an alternative embodiment of a stake for holding and supporting the hoop-shaped arch means.
Figure 5B:
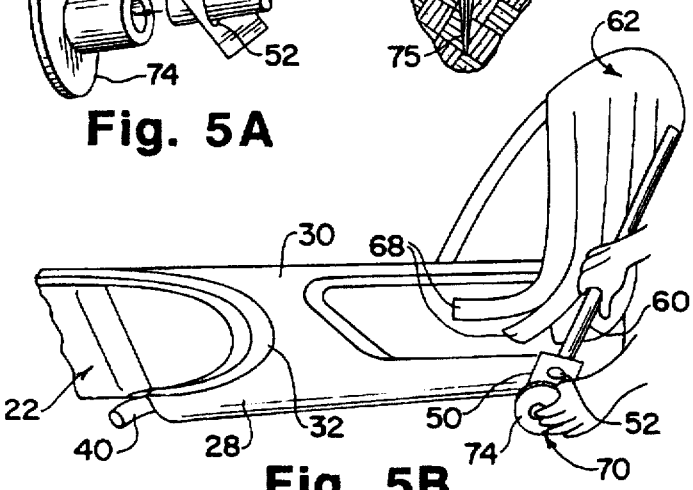

FIGS. 4, 5A and 5B show a curved hollow U-shaped hoop or arch member 60 for supporting a curtain-like member 62 by threading member 60 through a plurality of spaced loops 64 attached to the member 62. The curtain-like member 62 is slit along spaced parallel lines 66 to provide a plurality of flexible flaps 68, preferably having indicia 69 imprinted thereon for giving a child a sense of added adventure. In the example shown in the drawing, the indicia is a crocodile. An air inflated tube **60*a* (FIG. 4A) may also be used to hold the curtain-like member 62**, in which case the hoop and drape may be fabricated as a single integral member.

Each of the free ends of the hoop member 60 is fed through an aperture 52 (FIG. 2, 5A, 5B) of the retaining strap 50 and then placed into curtain stand 70. The stand 70 includes a cylindrical portion 72 with a radially extending flange 74 at one end thereof. This assembly takes place prior to filling the pool walls 28.

When the walls 28 are filled, they expand outwardly and embrace arch member 60 with a clamping-like action. By adjusting the length of retaining strap 50, the amount of force being exerted against the arch 60 can be predetermined. In addition, the weight of the pool walls 28 exert a downward and anchoring pressure upon flange 74. This design is very important because it holds the hoop and curtain in a proper vertical orientation, while being sufficiently flexible and yielding to avoid injuries if a sliding person impacts them. The inflated tube design shown in FIG. 4A achieves a similar result.

FIG. 5C shows another embodiment of a hoop 60 holding means. Here, attached to the upper end of a stake 75 is a cylinder portion 72a terminating at its upper end in a flange 74a that rests against the surface of the ground. In this embodiment, the fit between the cylinder 72a and hoop 60b should be tight enough to hold the hoop during normal usage, but also loose enough so that if a sliding person strikes the hoop, it will be dislodged and the person will not be injured. The hoop 60b should be made of a material which is soft enough so that its free end does not cause bodily injury after the hoop end is knocked out of the cylinder 72a.

Preferably, means are provided for filling the pool walls and the ramp/bump with water. However, it should be understood that other fluids may also be used. For example, the pool walls may be inflated with air.

Figure 6A:
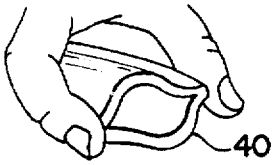
FIGS. 6A and 6B disclose details of an inlet/outlet tube and its association with a garden hose inserted therein.
Figure 6B:
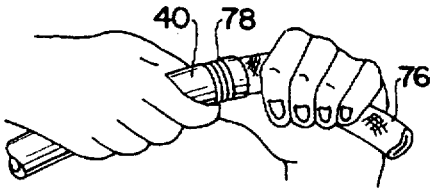

In greater detail, each of the inlet/outlet tubes 40, 42 (FIGS. 1, 2, 6A, 6B, and 8) is a generally flattened tube communicating with the interior of the pool walls 28. These tubes 40, 42 may be transformed from their initially flat condition into a substantially round cross-section by squeezing together (FIG. 6A) the opposite longitudinal edges of the tube. The resultant internal tube diameter is larger than the diameter of end fitting 78 normally found on a conventional garden hose 76. This slightly larger size provides two distinct advantages. First, it permits a ready telescoping of the hose fitting 78 within either inlet/outlet tube 40. Second, it provides egress for both air and water that must escape during the filling operation. Additionally, excess water can escape from the pool side wall 28, thereby preventing an overpressurization or overinflation.

Figure 7A:
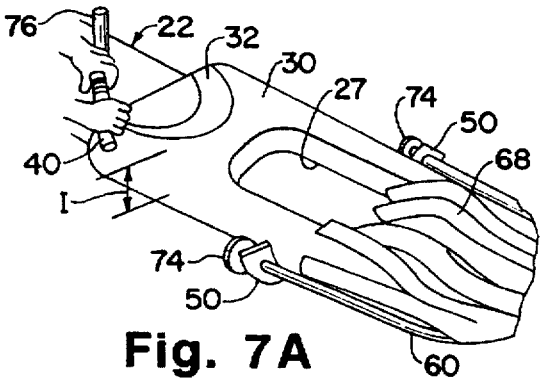
FIG. 7A shows a technique for filling and expanding the walls of the pool with a fluid medium, such as water, and for sealing the inlet/outlet tube.

As best seen in FIG. 7A, the water pressure is maintained during the filling operation by holding and squeezing the tube 40 around the garden hose 76 and fitting 78, to prevent an escape of excessive amounts of water. Since excess water so escapes, the internal pressure cannot rupture the side walls. The filling hose 76 is removed when the pool wall reaches its full capacity, normally not to exceed 8–10 inches in height at the ramp/bump, as shown (FIG. 7A) by arrow "T".

Figure 7B:
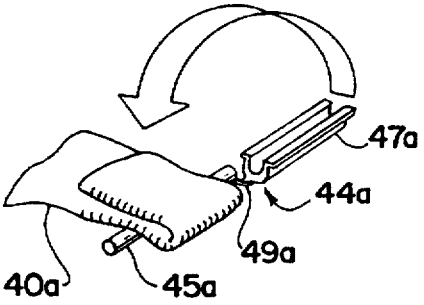
FIG. 7B shows, in an open position, an alternative embodiment of/device for sealing the fill tube.
Figure 7C:
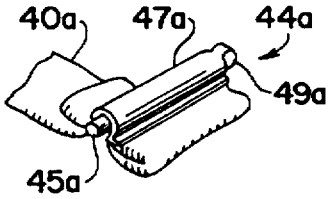
FIG. 7C shows the device of FIG. 7B in a closed position.

In the embodiment of FIGS. 7B, C, after the pool walls are filled with water, the inlet tube 40a is folded over itself (FIG. 7B) and a clamp 44a is slipped under the folded end. Clamp 44a has a solid rod 45a, connected to a resilient trough 47a with a C-shaped cross-section by a hinge section 49a. Then, the trough 47a is folded at hinge 49a to come to rest over rod 45a. The trough is pressed down (FIG. 7C) over the rod 45a and tube end, whereupon it is in a closed and sealed condition. The resilient C-shaped trough 47a acts as a pressure regulator. After there is a predetermined pressure level in the pool wall 28, the inlet tube 40a and outlet tube 42a open against the spring action of the C-shaped trough 47a, so that the pressure is relieved before the pool walls 28 reach a bursting pressure.

Figure 3B:
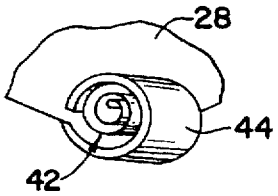
FIG. 3B is an enlarged detail of a rolled inlet/outlet tube retained in a sealed relation by a C-shaped spring element.

A garden hose connector may be attached to the ends of tubes 40, 42; however, without the pressure regulating of either the C-clamp 44 (FIG. 3B) or the C-shaped claim 47a, the pool could rupture. Also, if a garden hose connector is used, trapped air would likely remain in the pool walls to have an adverse effect upon both the bumps and the cushioning bumper A–G, which might be less safe or comfortable to the sliding person.

Figure 8:
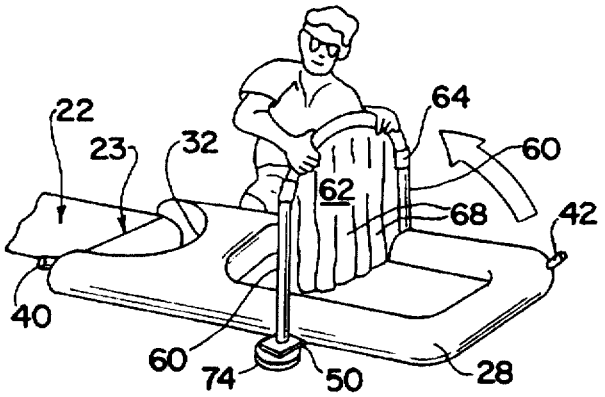
FIG. 8 is a partial perspective view showing the manner of moving the arch and curtain-like means into a desired final position relative to the pool.

With the pool walls 28 filled, the arch 60 and supporting curtain means 62 with its flaps 68 are raised by rotating about the axis of retaining strap 50, as shown by the arrow in FIG. 8. After such rotation, the stand flange 74 is positioned on the ground. The spacing between the apertures 52 in strap 50 causes the expanded pool walls 28 to apply a slight pressure on the opposite spaced legs of the arch 60 to insure a proper retention of the arch 60 and curtain means 62 in an upright and vertical position.

Figure 9A:
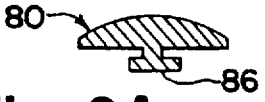
FIG. 9A is a cross-sectional view of the bight portion and the button-like protuberance of the staple-like member shown in FIG. 9.
Figure 9:
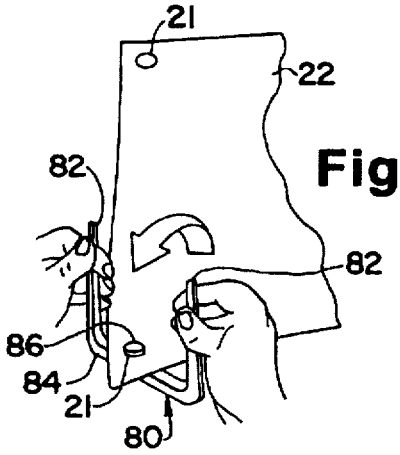
FIG. 9 discloses, in a partial perspective view, the assembly of a specialized large U-shaped staple-like stake member with a button-like protuberance on the underside of its bight portion, the protuberance being associated with an aperture in the corner portion of the slide.
Figure 10A:
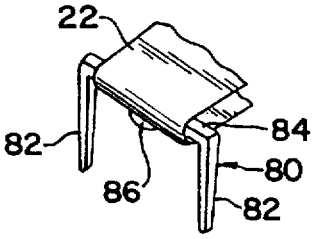
FIGS. 10A through 10D disclose a technique of wrapping the corner of the slide about the bight portion of the U-shaped stake member by rotation thereof about the axis of the bight portion, the wrap on the bias of the slide material, in order to encase the exposed portion of the stake with slide material when it is inserted into the ground.
Figure 10B:
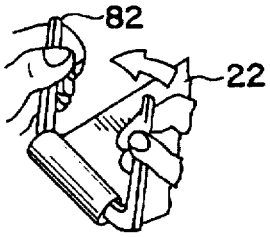
Figure 10C:
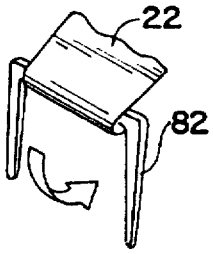
Figure 10D:
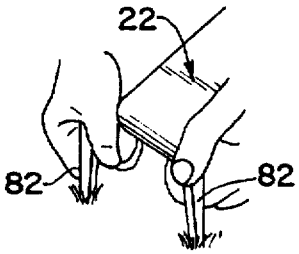

The weight of the water within the walls 28 insures a proper positioning of the pool 24 during its use. The slide 22 is manually pulled taut, extending longitudinally from its line of juncture with the base portion 26 of the pool 24. After the slide 22 is taut, staple 80 is used to secure it in place. This staple includes a spaced pair of pointed legs 82 joined to a bight portion 84 carrying a downwardly depending protuberance in the form of a button means 86 which is inserted into a corner aperture 21 in slide 22. Then, the staple 80 is rotated about the axis of the bight portion 84, in the direction of the arrow shown in FIG. 9. The continued rotation for about one and one-half turns (FIG. 10A through 10D) along the bias of slide 22, causes the material of slide 22 to substantially cover the bight portion 84 of the staple 80. When staple 80 is inserted into the ground, the staple is thus practically covered to prevent injury if there is any contact between it and a person who is sliding. The button facing downwardly is pressed into the ground again to protect against possible engagement with a slider.

The pool cavity 27 is filled with water 90. The slide 22 is covered with a film of water to make it more lubricious. The nose portion of the sprinkler cover 94 (FIG. 11) includes flap 95 which may be fixed to the earth a safe distance (approximately 2 feet) from the slide 22. The sprinkler has a nozzle which provides a wide fan-shaped cascade of water 97 for maintaining a film of water on the slide 22. Other lubricious materials, such as soap or silicone, can also be used.

In use, a person runs toward the slide 22 and bellyflops on it, as seen in FIG. 12A. Upon impacting the angled ramp/bump wall 32 (FIG. 2), the body of the sliding person is angled upwardly by bump A. The body momentum raises him over bump B which further increases the body's upward angle. On bump C, the body is catapulted upwardly and forwardly so that the sliding person's arms and body move through the flaps 68 of the curtain means 62. Then, he drops into the water 90 in the pool cavity 27. The forward motion is slowed by the water and a bump F and G at the far side of the pool.

If the sliding body does not have sufficient momentum to carry it into the pool, the soft, water or air filled bumps act as a shock absorber.

The slide portion 22 is preferably fabricated from a linear low density virgin polyethylene with slip additives. The pool portion is also made of a polyethylene material, preferably with elastomeric blends for added strength. While other materials, such as vinyl, may be substituted, polyethylene presently provides the best cost value. The staples 80 and 98 may be injection molded from any suitable plastic material that has the necessary strength and rigidity.

While other materials and manner of assembly will become apparent to those skilled in the art, we do not wish to be limited other than by the following claims, which are to be construed to cover equivalent structures.

We claim:

1. A water slide including in sequential combination an elongated member, a ramp, and a splash down pool, said water slide further including means for stabilizing the position of said water slide on an underlying supporting surface, means for causing the surface of said water slide to become lubricous and said pool providing a relatively shallow body of water spaced from said elongated member by said ramp, and means for defining said ramp and pool and for absorbing shock to protect a sliding body from injury upon an impact therewith, wherein said ramp interconnects said elongated member and said pool, and a portion of said ramp having a substantially semi-circular concave configuration said portion comprising a first substantially linear ramp segment extending along a chord of said semi-circular configuration and a second ramp segment of substantially semi-circular concave configuration spaced apart from said first ramp segment to guide and direct a body moving on said ramp into said pool.

2. A water slide comprising in sequential combination an elongated sheet of material which becomes slippery when wet, a ramp for elevating a person sliding on said elongated sheet off said sheet and into the air, a portion of said ramp having a substantially semi-circular concave configuration for guiding said sliding person toward a central portion of said ramp; said portion comprising a first substantially linear ramp segment extending along a chord of said semi-circular configuration and a second ramp segment of substantially semi-circular configuration; and a pool provided at a downstream location where said sliding person lands after having been elevated by said ramp.

3. The water slide of claim 2 wherein said ramp is fluid inflatable.

4. The water slide of claim 2 wherein said ramp comprises a series of segments of increasing height that extend transversely to said elongated sheet.

5. The water slide of claim 4 wherein said ramp segments comprise a series of tubes with successively increasing heights.

6. The water slide of claim 4 wherein said ramp comprises at least two segments with the first ramp segment spaced apart from the second ramp segment.

7. The water slide of claim 2 wherein said ramp and pool are formed by sheets of plastic which are secured together to form a plurality of fluid inflatable chambers.

8. The water slide of claim 7 wherein said fluid inflatable chambers of said ramp and pool are interconnected so that they can be inflated from a common fill point.

9. A water slide comprising in sequential combination an elongated sheet of material which becomes slippery when wet, a ramp for elevating a person sliding on said elongated sheet off said sheet and into the air, said ramp being formed from at least two segments with a first segment being spaced apart upstream a sufficient distance from a second segment so that each segment individually elevates the sliding person, said two segments comprising a first substantially linear segment and a second substantially semicircular concave segment wherein said first segment extends along a chord of said second segment, and a pool located at a point downstream where said sliding person lands after having passed over said ramp.

10. The water slide of claim 9 wherein said ramp segments have successively increasing heights.

11. The water slide of claim 9 wherein said ramp is fluid inflatable.

12. The water slide of claim 9 wherein said ramp and pool are formed by sheets of plastic which are secured together to form a plurality of fluid inflatable chambers.

13. The water slide of claim 12 wherein said fluid inflatable chambers of said ramp and pool are interconnected so that they can be inflated from a common fill point.

* * * * *